United States Patent [19]

Lockwood

[11] Patent Number: 5,016,773

[45] Date of Patent: May 21, 1991

[54] PAINT BRUSH HOLDER

[76] Inventor: Larry E. Lockwood, 341 Wilson Dr., Unit 4, Milton, Ontario, Canada, L9T 3Y9

[21] Appl. No.: 529,701

[22] Filed: May 30, 1990

Related U.S. Application Data

[63] Continuation of Ser. No. 339,696, Apr. 18, 1989, abandoned.

[51] Int. Cl.[5] ..... B65D 25/10

[52] U.S. Cl. ..... 220/90; 206/362; 206/209

[58] Field of Search ..... 220/90, 95; 206/361, 206/362, 372, 373, 209; 248/303; 211/70.6

[56] References Cited

U.S. PATENT DOCUMENTS

| | | | |
|---|---|---|---|
| Re. 23,911 | 12/1954 | Tetter | 220/90 |
| 228,692 | 11/1883 | Cowley et al. | 211/65 |
| 778,272 | 12/1904 | Roop . | |
| 1,024,841 | 4/1912 | Emery | 220/95 |
| 1,373,766 | 4/1921 | Sather | 206/209 |
| 1,471,712 | 10/1923 | Sohnle | 206/362 |
| 1,629,213 | 5/1927 | Hughes | 206/362 |
| 1,703,008 | 2/1929 | Justice | 220/90 |
| 1,754,366 | 4/1930 | Lissy | 248/113 |
| 1,865,283 | 6/1932 | Sohnle | 220/95 |
| 2,184,460 | 12/1939 | Linder | 220/90 |
| 2,355,549 | 2/1948 | Myers . | |
| 2,466,850 | 4/1949 | Hoffman et al. | 220/90 |
| 2,531,982 | 11/1950 | Marrier | 220/90 |
| 2,566,650 | 9/1951 | Anderson | 211/65 |
| 2,567,788 | 9/1951 | Salmon | 220/95 |
| 2,578,233 | 3/1947 | Entsminger | 220/90 |
| 2,646,808 | 7/1953 | Yenne | 206/209 |
| 2,648,460 | 8/1953 | Tatter | 220/90 |
| 2,672,256 | 3/1954 | Sebell | 220/90 |
| 2,726,011 | 12/1955 | Young | 220/95 |
| 2,742,180 | 4/1956 | Mijevich | 220/90 |
| 2,791,350 | 5/1957 | Mennen | 220/95 |
| 2,815,146 | 12/1957 | Silver | 220/90 |
| 2,823,399 | 2/1958 | Stewart | 220/90 |
| 2,950,840 | 4/1960 | Lewerth Geb Franz | 220/95 |
| 2,952,364 | 1/1961 | Jacobson . | |
| 3,185,311 | 11/1963 | Roberts et al. . | |
| 3,261,053 | 7/1966 | Lesher | 220/95 |
| 3,341,061 | 9/1967 | Cortina | 220/90 |
| 4,060,215 | 11/1977 | Burns et al. | 206/362 |
| 4,852,833 | 8/1989 | Lockwood | 206/209 |
| 4,860,891 | 8/1989 | Biggio | 220/90 |

FOREIGN PATENT DOCUMENTS

| | | | |
|---|---|---|---|
| 1476273 | 4/1967 | France | 220/95 |
| 13437 | 6/1913 | United Kingdom | 211/65 |
| 2145617 | 4/1985 | United Kingdom | 220/1 T |

*Primary Examiner*—Stephen Marcus
*Assistant Examiner*—S. Castellano
*Attorney, Agent, or Firm*—Sim & McBurney

[57] ABSTRACT

A novel paint brush holder for holding a plurality of paint brushes in a bucket is described. The paint brush holder is of generally planar construction and has a resilient ring member which resiliently engages the inner wall of the paint bucket when in use and which is resiliently inwardly flexible to remove the paint brush holder from and to insert the paint brush holder into the paint bucket. Radially-inwardly directed prongs are provided as paint brush supports and a radially-inwardly directed wiping bar also is provided.

9 Claims, 2 Drawing Sheets

FIG. 3
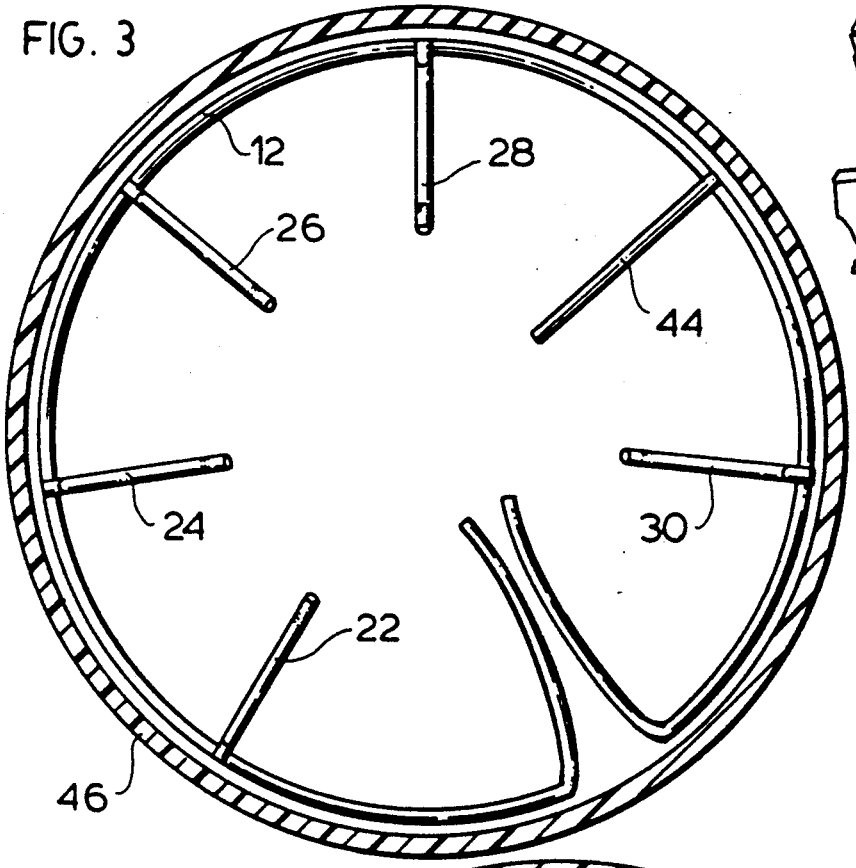
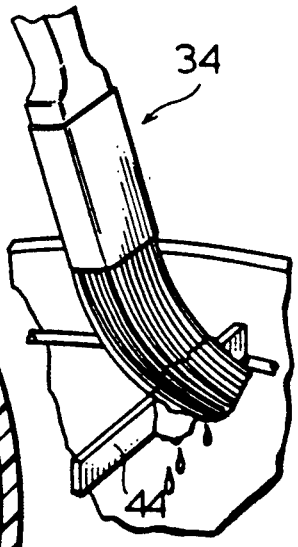
FIG. 5
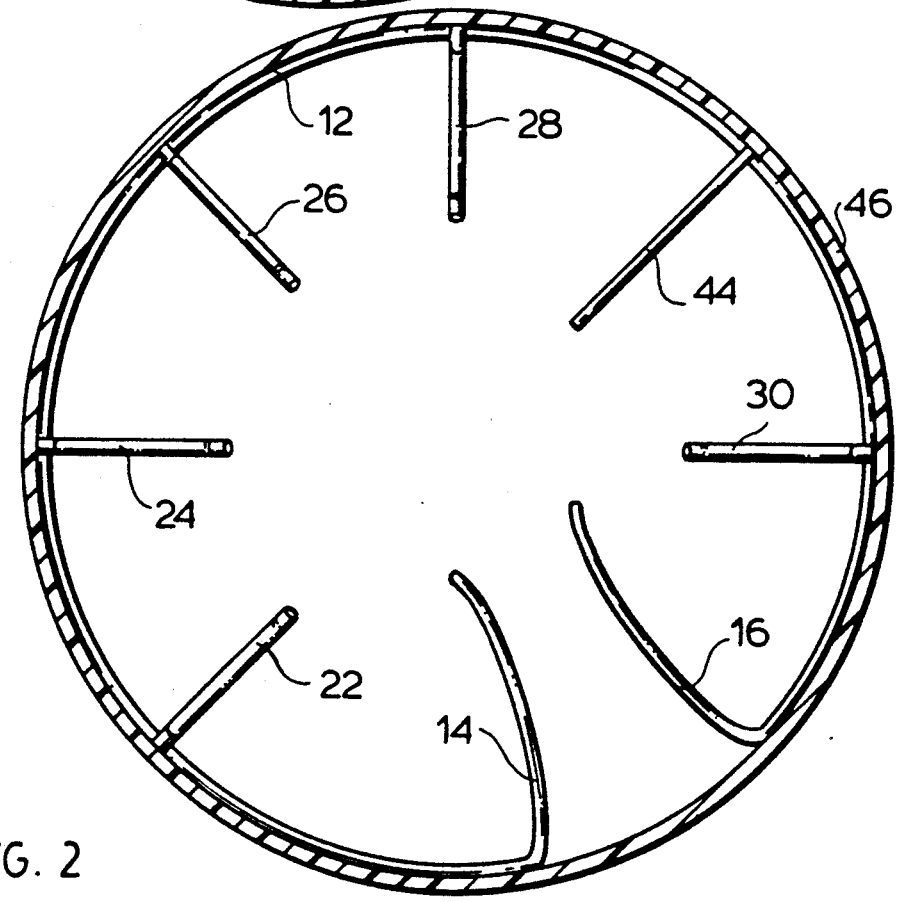
FIG. 2

PAINT BRUSH HOLDER

This is a continuation of copending application Ser. No. 339,696 filed Apr. 18, 1989.

FIELD OF INVENTION

The present invention relates to paint brush holders, in particular to a unique portable paint brush holder, used in combination with a paint bucket.

A variety of paint brush holders has been described in the prior art. A search with respect to the device disclosed herein has revealed U.S. Pat. Nos. 778,272, 2,355,549, 2,466,850, 2,578,233, 2,952,364 and 3,185,311.

U.S Pat. No. 778,272 shows the use of a support for a paint brush in a paint can. U.S. Pat. Nos. 2,335,549 and 2,466,850 show the use of wiper bars for excess paint in conjunction with paint cans, and, in the case of U.S. Pat. No. 2,466,850, in combination with a paint brush holder. U.S. Pat. No. 2,578,233 shows a combined paint can handle and brush holder arrangement. U.S. Pat. No. 2,952,364 shows a removable insert for supporting a plurality of brushes inserted in a paint can. U.S. Pat. No. 3,185,311 shows an arrangement for holding brushes of different sizes in a paint can.

None of these prior art structures discloses or suggests the unique paint brush holder of this invention, as will be apparent from the discussion below.

SUMMARY OF INVENTION

In accordance with the present invention, there is provided a paint brush support for removable insertion into a container having an internal diameter. The paint brush holder comprises frame means dimensioned to be located within the container. The frame means comprises a ring member which is resiliently deformable from a first diameter corresponding to the inside diameter of the container at the location of said paint brush support therein to a lesser diameter to permit the paint brush support to be inserted into and removed from the container and to be mounted in the container with the ring member resiliently engaging an inner wall of the container.

The paint brush support further comprises paint brush holder means in the form of a plurality of elongate prongs extending inwardly from the ring member and dimensioned to be received through openings in paint brush handles to support paint brushes thereby in a substantially vertical orientation. Bar means extends also inwardly from the ring member to act as a scraping bar for removal of excess paint from a brush. A pair of arm means extends inwardly from circumferential ends of the ring member adjacent one another to permit the pair of arm means to be gripped and to be drawn towards each other to effect the resilient deformation to a lesser diameter.

The paint brush support of the present invention, therefore, employs a resilient ring member which engages the inner wall of the container to be supported thereby and which has paint brush support prongs and a paint scraper bar inwardly extending therefrom. Resilient inward deformation of the ring member is effected by drawing together two arms which extend inwardly from the respective ends of the ring member.

The paint brush support of the invention is relatively simple in design, of generally planar shape and yet is very effective in enabling a plurality of paint brushes to be supported in a container.

BRIEF DESCRIPTION OF DRAWINGS

FIG. 2 is a plan view of the paint brush holder of FIG. 1 positioned in a container;

FIG. 3 is a plan view of the paint brush holder of FIG. 1 resiliently inwardly deformed for removal from or insertion into the container;

FIG. 5 is a detail view of the scraping of excess paint from a paint brush.

DESCRIPTION OF PREFERRED EMBODIMENT

Figure 1:
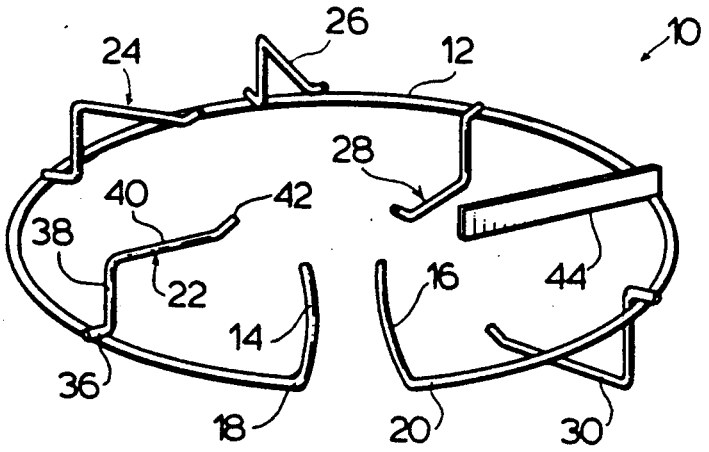
FIG. 1 is a perspective view of a paint brush holder provided in accordance with one embodiment of the invention.

Referring to the drawings, there is illustrated therein a paintbrush holder 10 provided in accordance with one embodiment of the invention. The paint brush holder 10 has a frame in the form of a resilient ring member 12 which has a pair of arms 14, 16 extending substantially radially-inwardly from the circumferential ends 18, 20 of the ring member 12. The arms 14, 16 are integrally formed with the ring member 12 and convexly-bowed one toward the other to facilitate gripping of the arms to effect resilient inward movement of the ring member 12 by drawing the arms 14 and 16 one toward the other.

Figure 4:
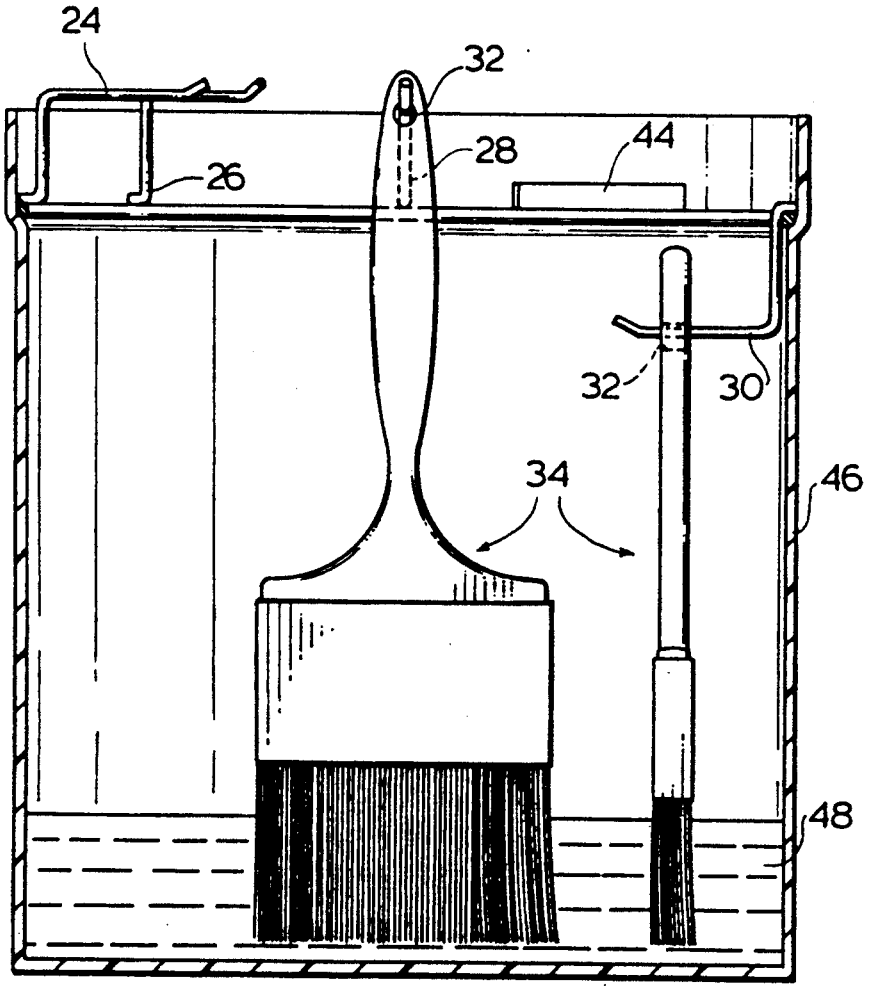
FIG. 4 is a sectional view of the paint brush holder of FIG. 1 positioned in a container.

A plurality of prongs 22, 24, 26, 28 and 30 is provided extending radially inwardly from the ring member 12. The prongs are dimensioned to be received through openings 32 in the handles of paint brushes 34 so as to support paint brushes thereby in a substantially vertical orientation, as seen in FIG. 4.

Each of the prongs is identically shaped and includes a first portion 36 which is molded or otherwise rigidly attached to the ring member 12, a second portion 38 which, in the case of prongs 22, 24 and 26, extend upwardly and, in the case of prongs 28 and 30 extend downwardly, a radially-inwardly directed portion 40 and an upturned portion 42 at the radially-inner extremity. The upturned portion 42 assists in maintaining the brushes 34 in position on the prongs. The provision of an upwardly-directed portion 38 in some instances and a downwardly-directed portion 38 in others enables paint brushes of differing lengths to be supported by the holder, as seen in FIG. 4.

Also extending radially inwardly from the ring member 12 is a wiper bar 44 for the removal of excess paint from a brush 34, as seen in the detail of FIG. 5. The wiper bar 44 is located with its wider dimension extending upwardly to facilitate such wiping.

The prongs 22, 24, 26, 28 and 30, wiper bar 44 and arms 14 and 16 are arranged substantially equally circumferentially spaced about the ring member 12.

The paint brush holder 10 is intended to be removably located in a paint bucket 46 to suspend paint brushes 34 therein, which may also contain paint 48. The paint bucket 46 may have a suitable lid to enclose the brushes and paint for transportation or storage. While the bucket 46 is illustrated as possessing a right-cylindrical construction, it may have any desired construction, including tapered walls.

The paint brush holder 10 is maintained in its intended location within the bucket 46 by resilient engagement between the ring member 12 and the adjacent inside surface of the bucket 46. To locate the paint brush holder 10 within the bucket 46, the paint brush holder 10 is resiliently flexed inwardly by pulling the arms 14 and 16 towards one another, the paint brush holder 10 is located in the bucket 46 and the holder 10 is allowed to resiliently flex outwardly into gripping engagement with the inner wall of the bucket 46 at the desired vertical location therein by releasing the arms 14 and 16.

The paint brush holder 10 may have any convenient diameter, consistent with the size of the paint bucket 46 with which the device is to be employed. Any convenient number of prongs may be provided, depending on the number of paint brushes with which the device is to be employed.

SUMMARY OF INVENTION

In summary of this disclosure, the present invention provides a novel form of paint brush holder which is readily located in and removed from a paint bucket for holding a plurality of paint brushes therein by resilient flexure and which is accurately and permanently positioned in the bucket. Modifications are possible within the scope of this invention.

What I claim is:

1. A paint brush support for removable insertion into a container having an internal diameter, comprising:

frame means dimensioned to be located within said container and comprising a ring member which is located in a plane and which is resiliently deformable from a first diameter corresponding to the inside diameter of the container at the location of insertion therein to a lesser diameter to permit said paint brush support to be inserted into and removed from said container and to be mounted in said container with said ring member resiliently engaging an inner wall of said container, paint brush holder means in the form of a plurality of elongate prongs mounted in fixed relation to and extending radially inwardly from said ring member to a free end and dimensioned to be received at said free end through openings in paint brush handles to support paint brushes thereby in a substantially vertical orientation, bar means mounted in fixed relation to and extending radially inwardly from said ring member in said plane to a free end to act as a scraping bar for removal of excess paint from a brush, and a pair of arms integrally formed with said ring member and extending generally radially inwardly in said plane from circumferential ends of said ring member to free ends adjacent one another to permit said pair of arms to be gripped and to be drawn towards each other to effect said resilient deformation of said ring member to said lesser diameter.

2. The device of claim 1 wherein each of said prongs is of substantially the same length.

3. The device of claim 2 wherein each of said prongs comprises a first portion extending vertically from said ring member and a second portion extending radially inwardly from said first portion.

4. The device of claim 3 wherein some of said prongs have said first portion extending vertically upwardly while others of said prongs have said first portion extending vertically downwardly.

5. The device of claim 4 wherein each said prongs has an upturned portion at the radially-inward extremity of said second portion.

6. The device of claim 1 wherein said prongs, bar means and arm means are arranged substantially symmetrically about said ring member.

7. The device of claim 6 wherein said bar means is arranged substantially vertically extending.

8. The device of claim 1 wherein said arm means are inwardly bowed towards one another to facilitate gripping of said arm means to effect said resilient deformation.

9. The paint brush holder of claim 1 having an integral construction and formed of resilient steel.

* * * * *